US006945719B2

(12) United States Patent
Hurd

(10) Patent No.: US 6,945,719 B2
(45) Date of Patent: Sep. 20, 2005

(54) CAM ACTION SHAFT LOCK DEVICE AND METHOD

(75) Inventor: Bruce E Hurd, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 170 days.

(21) Appl. No.: 10/686,996

(22) Filed: Oct. 16, 2003

(65) Prior Publication Data

US 2005/0084312 A1 Apr. 21, 2005

(51) Int. Cl.[7] ..... B41J 29/56
(52) U.S. Cl. ..... 400/355; 400/674; 101/93.11
(58) Field of Search ..... 400/334, 335, 400/352, 354, 355, 356, 357, 663, 674; 101/47, 101/57, 93, 93.11

(56) References Cited

U.S. PATENT DOCUMENTS 4,403,879 A * 9/1983 Vought et al. ..... 400/674
4,773,773 A * 9/1988 Itoh ..... 400/59
5,366,305 A * 11/1994 Christianson ..... 400/354
6,435,650 B1 * 8/2002 Nishioka et al. ..... 347/37
6,524,021 B2 * 2/2003 Johnson et al. ..... 400/354

* cited by examiner

*Primary Examiner*—Stephen R. Funk
(74) *Attorney, Agent, or Firm*—Michael J. Cummings; Charles R. Malandra, Jr.; Angelo N. Chaclas

(57) ABSTRACT

A method and device for locking and unlocking a print head assembly along a shaft in an addressing machine. The print head assembly is fixedly mounted on a locking mechanism, which comprises a cylindrical body slideably mounted on the shaft and a cam ring rotatably mounted over the cylindrical body. The cylindrical body has a slot for seating an elongated spline. When the locking mechanism is operated in a locking position, the inner circumference of the cam ring presses the spline against the shaft, preventing the cylindrical body from moving along the shaft. The cam ring has a relief on its inner circumference such that, when the cam ring is rotated to the unlocked position, the spline is partially seated in the relief, thereby reducing the pressure exerted by the spline against the shaft. As such, the position of the print head assembly can be adjusted.

14 Claims, 6 Drawing Sheets

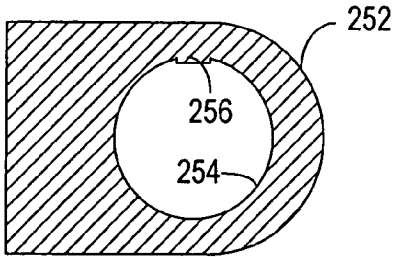
FIG. 9
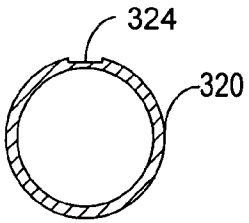
FIG. 10
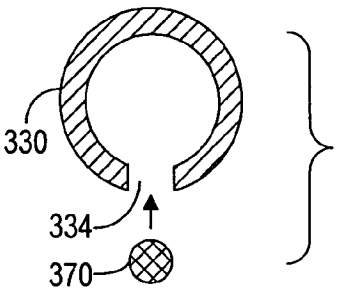
FIG. 11
FIG. 12
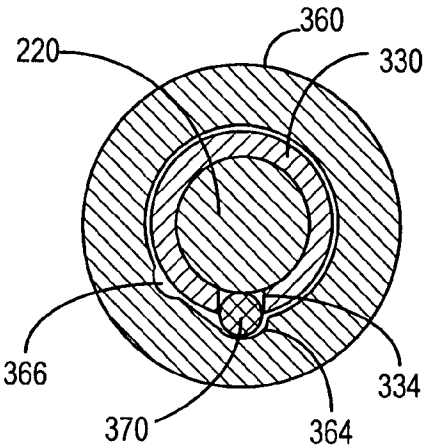
FIG. 13
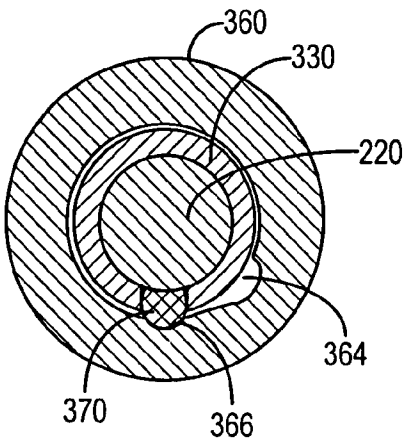
FIG. 14

CAM ACTION SHAFT LOCK DEVICE AND METHOD

FIELD OF THE INVENTION

The invention disclosed herein relates generally to an addressing machine in a mass mailing system and, more particularly, to a locking mechanism for locking a print head assembly in the addressing machine.

BACKGROUND OF THE INVENTION

In a mass mailing system, an addressing machine having a plurality of print heads is typically used to print a mailing address on an envelope along with other printed items, such as the postage indicia, return address and promotional messages. Because the size of the envelope may vary, the print head in the addressing machine must be adjusted. Typically, the print heads are mounted on one or more shafts so that the position of the print heads can be adjusted along the longitudinal axis of the shaft, which is substantially perpendicular to the moving direction of the envelope.

As shown in FIG. 1*a*, the addressing machine 1 comprises an envelope feeder 10 and a printing section 100. The envelope feeder 10 has a driving mechanism 16 for releasing one envelope 14 at a time from a stack 12 to the printing section 100. The printing section 100 has a driving mechanism 20 and a pair of pickup rollers 22 to move the released envelope 14 further along the moving direction 90. While the envelope 14 is moving along the moving direction 90, a plurality of print head assemblies 40 is used to print the printed items on the envelope 14.

A top view of the printing section 100 is shown in FIG. 2. As shown, the printing section 100 has a rack 200 for mounting a plurality of shaft mounts 210. The print head assemblies are mounted on a plurality of shafts 220, which are mounted on the shaft mounts 210. In order to adjust the print head assemblies 40 relative to the moving path 92 of the envelope 14, the print head assemblies 40 can be slid on the shafts 220. Once each of the print head assemblies 40 has been moved to a desired position, it is locked in that position so that the printed items on the envelope 14 can be printed in a designated area in a consistent fashion. Advantageously, the print head assembly 40 comprises a plurality of print heads fixedly mounted on a carriage 50, which is slideably mounted on the shaft 220.

Furthermore, a machine operator should be able to rotate the print head assemblies 40 upward, as shown in FIG. 3, to occasionally clean the print heads on the assemblies.

Thus, it is desirable and advantageous to provide a method and device for locking and unlocking the print head assemblies so that the position of the print head assemblies relative to the moving path of the envelope can be easily changed or adjusted. Furthermore, it is desirable and advantageous to have a reasonably small locking mechanism so that it will not interfere with the operator when the operator adjusts the position of the print head assemblies and when the operator lifts the print head assemblies for cleaning or other maintenance purposes.

SUMMARY OF THE INVENTION

The present invention provides a method and mechanism for locking and unlocking a device for engaging connecting a carriage to a shaft, such that when the device is unlocked, the carriage position along the shaft can be adjusted, and when the device is locked, the adjusted position is maintained. This objective can be achieved by using a cylindrical body slideably mounted on the shaft, and a cam ring rotatably mounted over the cylindrical body. The shaft has a slot for seating a spline, and the inner circumference of the cam ring presses the spline against the shaft for locking the cylindrical body against the shaft. The inner circumference has a relief such that, when the cam ring is rotated to the unlocked position, the spline is partially seated in the relief, thereby reducing the pressure exerted by the spline against the shaft.

Thus, according to the first aspect of the present invention, there is provided a locking device for use in conjunction with a shaft for engagingly connecting to a carriage, the shaft having a longitudinal axis. The locking device comprises:

a cylindrical body slideably mounted on the shaft, the cylindrical body having an inner circumference, an outer circumference, a thickness defined by the inner and outer circumferences, and an aperture opened through the thickness of the cylindrical body, wherein the cylindrical body further has a mounting mechanism for engagingly attaching the carriage;

an elastomer body, seated in the aperture, for providing a frictional force against the shaft when the elastomer body is pressed toward the shaft; and a cam ring having an inner surface mounted over the outer circumference of the cylindrical body for rotational movement about a rotation axis between a first position and a second position, the rotational axis substantially parallel to the longitudinal axis of the shaft, the cam ring having a clearance on the inner surface, wherein when the cam ring is located at the first position, the clearance is spaced from the aperture, and the inner surface of the cam ring presses the elastomer body toward the shaft, providing a frictional force against shaft, thereby restricting the cylindrical body from moving along the longitudinal axis, and when the cam ring is located at the second position, the clearance is aligned with the aperture on the cylindrical body, allowing the elastomer body to seat partially in the clearance, thereby reducing the frictional force against the shaft such that the cylindrical body can be moved along the longitudinal axis for adjusting the position of carriage along the shaft.

Preferably, the cylindrical body has a coaxially extended section, the extended section having an outer circumference, and wherein the carriage has a flange, the flange having an opening for mounting over the outer circumference of the extended section.

Preferably, the flange has a tab protruding into the opening of the flange, and wherein the extended section has a slot cutting into the out circumference of the extended section for seating the tab so as to prevent the flange from rotating relative to the extended section.

Preferably, the extended section has a threaded segment, the locking device further comprising a lock nut for engaging with threaded section in order to keep the flange fixedly mounted on the extended section.

Preferably, the flange is mounted on the extended section between the lock nut and the cam ring.

Preferably, the cam ring has a further clearance which is shallower than the clearance such that when the cam ring is located at second position, the elastomer body is partially seated in the further clearance but substantially maintaining the frictional force against the shaft for restricting the cylindrical body from moving along the longitudinal axis.

Thus, according to the first aspect of the present invention, there is provided a locking device for use in conjunction with a shaft for engagingly connecting to a carriage, the shaft having a longitudinal axis. The locking device comprises 1) providing a locking device, slideably mounted on the shaft, for securely attaching the carriage, the locking device comprising:

a cylindrical body, having an inner circumference adjacent the shaft, an outer circumference, a thickness defined by the inner and outer circumferences, and an aperture opened through the thickness of the cylindrical body;

an elastomer body, seated in the aperture, for providing a frictional force against the shaft when the elastomer body is pressed toward the shaft;

a cam ring having an inner surface mounted over the outer circumference of the cylindrical body for rotational movement about a rotational axis, between a first position and a second position, the rotational axis substantially parallel to the longitudinal axis of the shaft, the cam ring having a clearance on the inner surface, such that when the cam ring is located at the first position, the clearance is spaced from the aperture, causing the inner surface to press the elastomer body toward the shaft, thereby providing a frictional force against the shaft, and when the cam ring is located a the second position, the clearance is aligned with the aperture of the cylindrical body, allowing the elastomer body to seat partially in the clearance, thereby reducing the frictional force against the shaft;

2) rotating the cam ring to the second position to reduce the friction force against the shaft, so as to adjusting the position of the carriage along the shaft; and 3) rotating the cam ring to the first position so as to provide a frictional force against the shaft, thereby maintaining the adjusted position of the carriage.

Reversing the cam ring reverses the locking direction from counter clockwise to clockwise or visa versa.

According to the third aspect of the present invention, there is provided an addressing machine having at least one print head assembly for printing a substantially flat item moving a moving direction, the flat item has a size, the addressing machine comprising:

at least one shaft having a longitudinal axis, substantially perpendicular to the moving direction of the flat item;

a shaft mount for mounting the shaft; and a locking device comprising:

a cylindrical body slideably mounted on the shaft, the cylindrical body having an inner circumference, an outer circumference, a thickness defined by the inner and outer circumferences, and an aperture opened through the thickness of the cylindrical body, wherein the cylindrical body further has a mounting mechanism for engagingly attaching the print head assembly;

an elastomer body, seated in the aperture, for providing a frictional force against the shaft when the elastomer body is pressed toward the shaft; and a cam ring having an inner surface mounted over the outer circumference of the cylindrical body for rotational movement about a rotation axis between a first position and a second position, the rotational axis substantially parallel to the longitudinal axis of the shaft, the cam ring having a clearance on the inner surface, wherein when the cam ring is located at the first position, the clearance is spaced from the aperture, and the inner surface of the cam ring presses the elastomer body toward the shaft, providing a frictional force against shaft, thereby restricting the cylindrical body from moving along the longitudinal axis, and when the cam ring is located at the second position, the clearance is aligned with the aperture on the cylindrical body, allowing the elastomer body to seat partially in the clearance, thereby reducing the frictional force against the shaft such that the cylinder body can be moved along the longitudinal axis for adjusting the position of carriage along the shaft relative to the moving direction, based on the size of the flat item.

The flat item can be an envelope, a sheet of paper or a mailpiece.

The present invention will become apparent upon reading the description taken in conjunction with FIG. 1 to 14.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 9 is a cross sectional view of the carriage flange.

FIG. 10 is a cross sectional view of the threaded section of the locking body.

FIG. 11 is a cross sectional view showing the lock section of the locking body and a spline.

FIG. 12 is a cross sectional view of the cam ring, according to the present invention.

FIG. 13 is a cross sectional view showing the cam ring operated in the unlocked position.

FIG. 14 is a cross sectional view showing the cam ring operated in the locked position.

DETAILED DESCRIPTION OF THE PRESENT INVENTION

Figure 4:
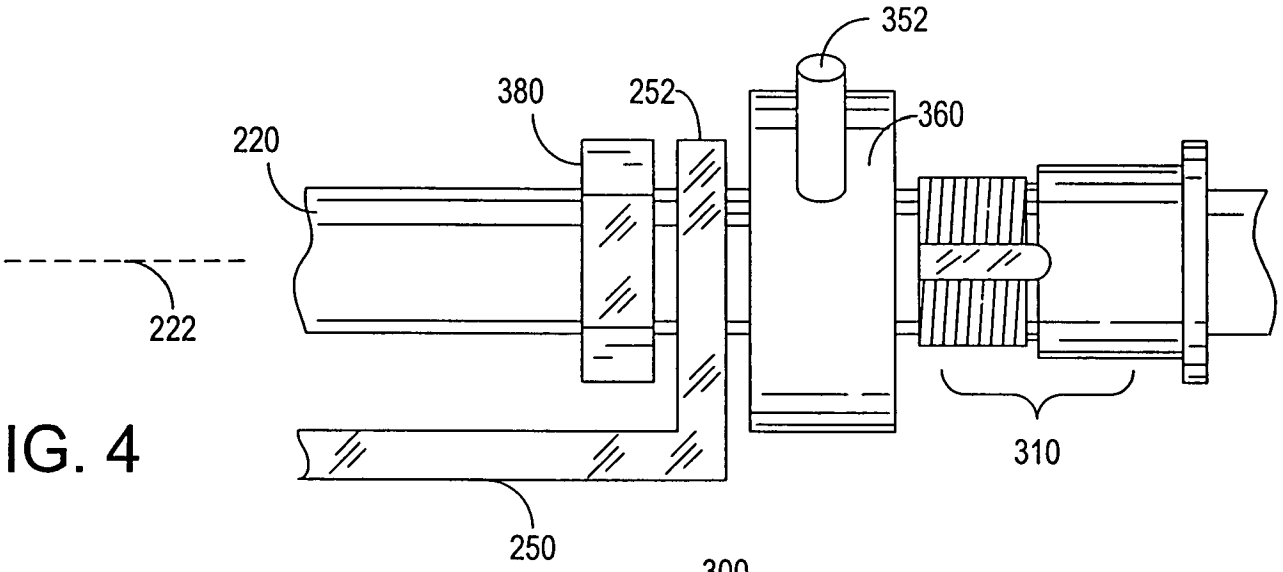
FIG. 4 is an exploded view showing the locking device and part of the print head assembly relative to the shaft, according to present invention.
Figure 8B:
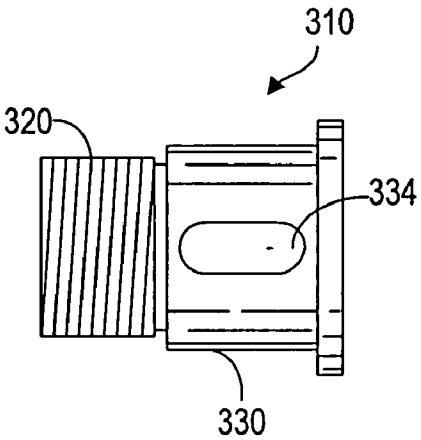
FIG. 8*b* is a bottom view showing the locking body of FIG. 8*a*.

In describing the present invention, reference is made to the drawings, wherein there is seen in FIG. 4 shows an exploded view of the locking device 300 and part of a carriage arm 250. The carriage arm 250 is part of the carriage 50 for mounting the print heads in the print head assembly 40 (see FIG. 2). The carriage arm 250 has a carriage flange 252 to be mounted on the locking device 300. As shown in the figure, the locking device 300 comprises a locking body 310, a cam ring 360, a lock nut 380, and an elongated spline 370 (see FIGS. 11, 13, 14). The locking body 310 is basically a cylindrical body having an inner diameter slightly larger than the outer diameter of the shaft 220, so that when the locking device 300 is not operated in a locked position, the locking body 310 can be moved from one part of the shaft to another in order to adjust the position of the print head assembly 40. The locking body 310 has a threaded section 320 joining a lock section 330, and a flange 350 at the end of the lock section 330, as shown in FIGS. 8*a* and 8*b*.

Figure 5:
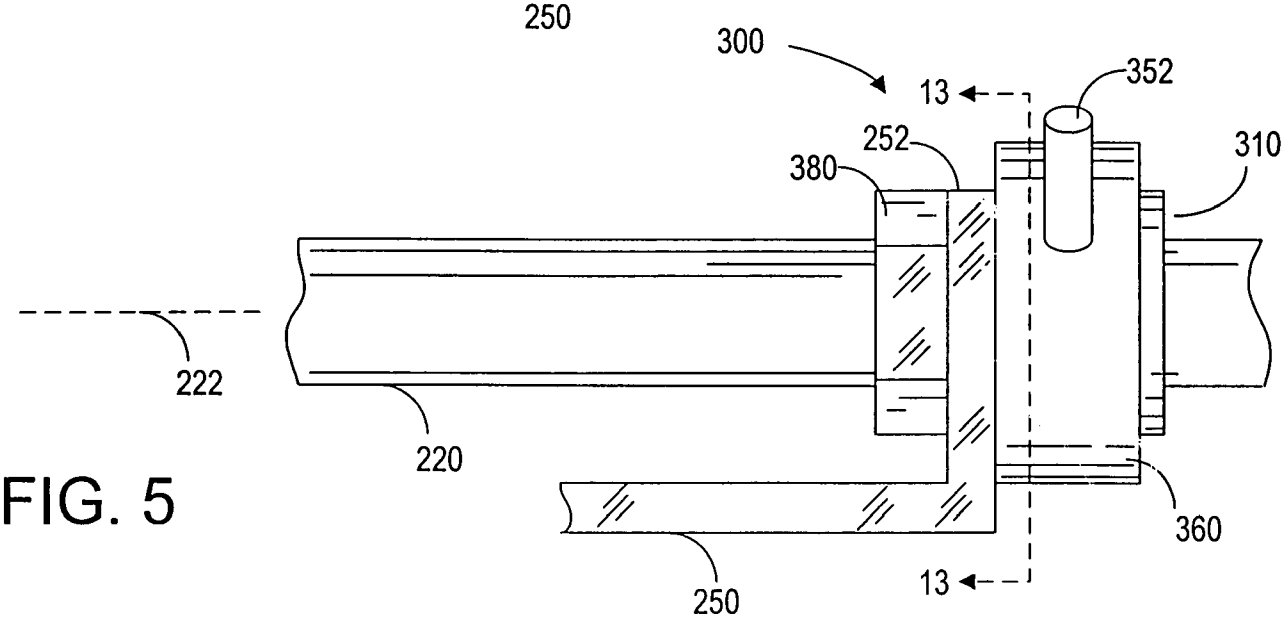
FIG. 5 is a top view showing the locking device and part of the print head assembly, wherein the locking device is operated in a first position.
Figure 7:
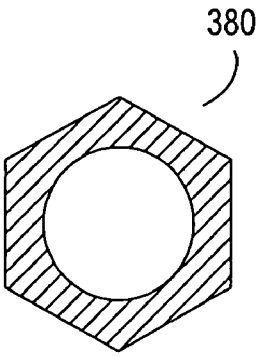
FIG. 7 is a cross sectional view showing a lock nut.

FIG. 5 is a top view showing all the components in the locking body 310 assembled to engagingly attach the carriage flange 252. As can be seen in FIGS. 12 to 14, the cam ring 360 has an inner diameter slightly larger than the outer diameter of the lock section 330 so as to allow the cam ring to rotate relative to the lock section about the longitudinal axis 222. The outer diameter of the flange 350 is larger than the inner diameter of the cam ring 360 in order to retain the cam ring 360. The carriage flange 252 has a circular opening 254, the diameter of the circular opening 254 is slightly larger than the outer diameter of the threaded section 320 of the locking body 310, so that the carriage flange 252 can be slipped through the threaded section 320 up to the lock section 330. As can be seen in FIGS. 8*a*, 9 and 10, the threaded section 320 has an anti-rotation slot 324, and the carriage flange 252 has a tab 256, protruding into the inner surface of the circular opening 254. When the carriage flange 252 is slipped over the threaded section 320, the tab 256 is fittingly seated in the anti-rotation slot 324, such that the carried flange 252 cannot be rotated about the longitudinal axis 222 of the shaft 220 relative to locking body 310. As such, when the cam ring 360 is rotated about the longitudinal axis 222 relative to the locking body 310, it does not cause the carriage flange 252 to rotate. Finally, a lock nut 380 is used to keep all the components together as the components are assembled. The lock nut 380 is shown in FIG. 7.

Figure 6:
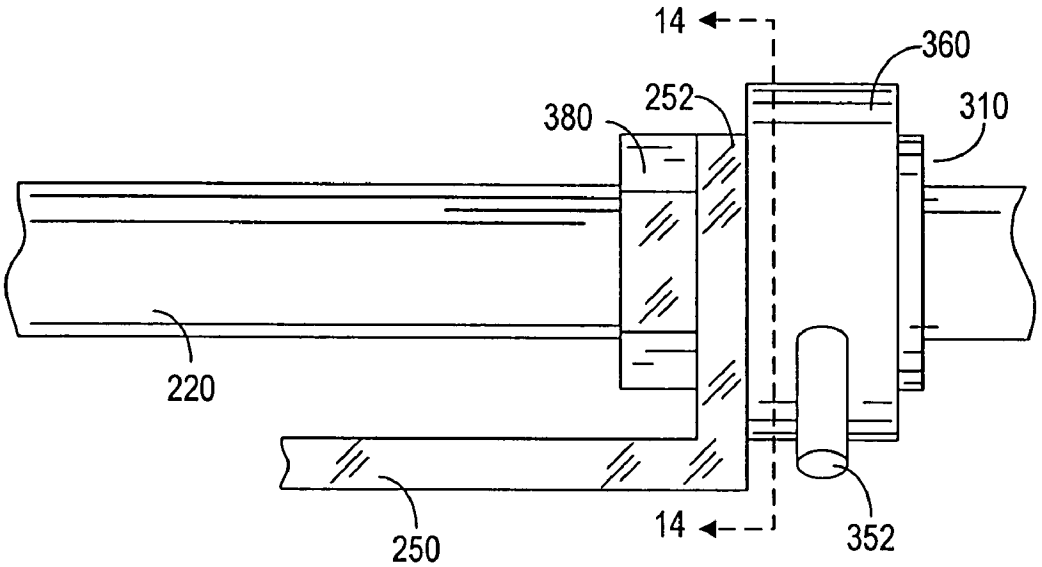
FIG. 6 is a top view showing the locking device and part of the print head assembly, wherein the locking device is operated in a second position.

As shown in FIGS. 5 and 6, the cam ring 360 has a lever 352, so as to allow an operator to rotate the cam ring 360 from one position to another in order to lock and unlock the locking body 310 relative to the longitudinal axis 222 of the shaft 220.

Figure 8A:
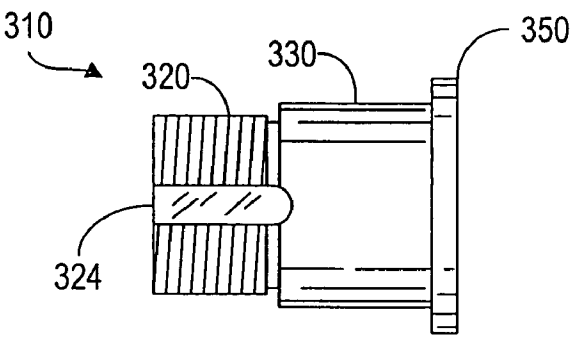
FIG. 8*a* is a top view of the locking body, according to the present invention.

FIG. 8*a* is a top view of the locking body 310. As shown, the anti-rotation slot 324 is an elongated slot, communicating the length of the threaded section 320. FIG. 8*b* is a bottom view of the locking body 310. A shown in the figure, the lock section 330 of the locking body 310 has an elongated aperture or through-slot 334. The slot 334 is also shown the cross sectional view of the lock section 330, as shown in FIG. 11. The slot 334 is used to seat a spline 370, which is made of a high friction material, a durable elastomer such as urethane, for locking purposes.

To facilitate the locking and unlocking function of the locking body 310, an elongated relief 364 is provided on the inner surface of the cam ring 360, as shown in FIG. 12. When the cam ring 360 is rotated to a position such that the elongated relief 364 is substantially aligned with the slot 334 in the threaded section 320, the spline 370 can partially move into the relief 364, as shown in FIG. 13. As such, the spline 370 does not exert pressure on 220, allowing the locking body 310 to be moved from one part of the shaft 220 to another part of the shaft 220 along the longitudinal axis 222. When the cam ring 360 is rotated to another position such that the elongated relief 364 is no longer aligned with the slot 334, the spline 370 is pushed toward the shaft 220 through the slot 334 by the inner surface of the cam ring 360. As such, a strong pressure exerted against the shaft 220 by the spline 370. The high friction between the spline 370 and the shaft 220 prevents the locking body 310 from sliding.

Figure 1:
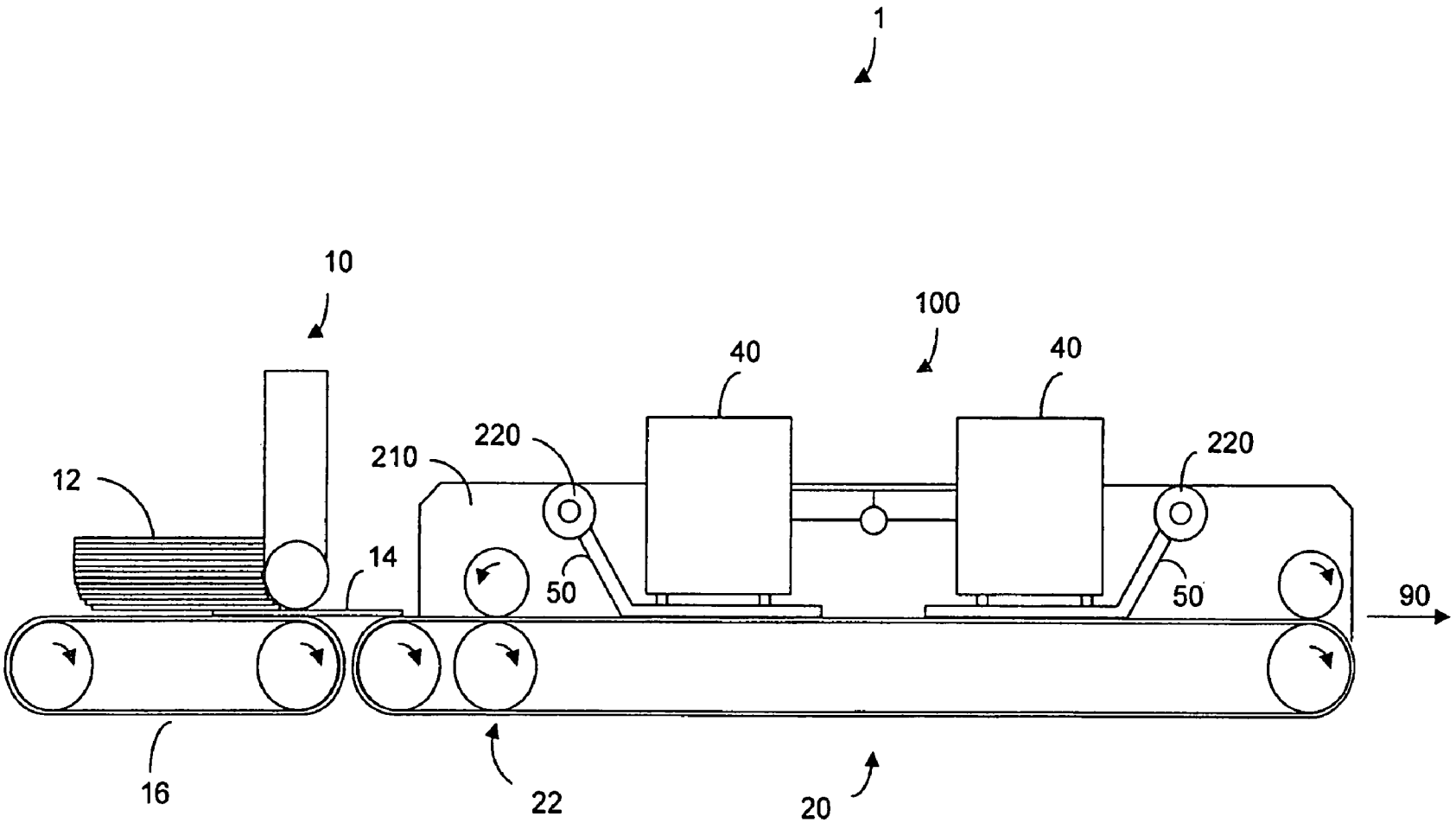
FIG. 1 is a schematic representation showing an addressing machine having a plurality of print head assemblies to print printed items on an envelope.
Figure 2:
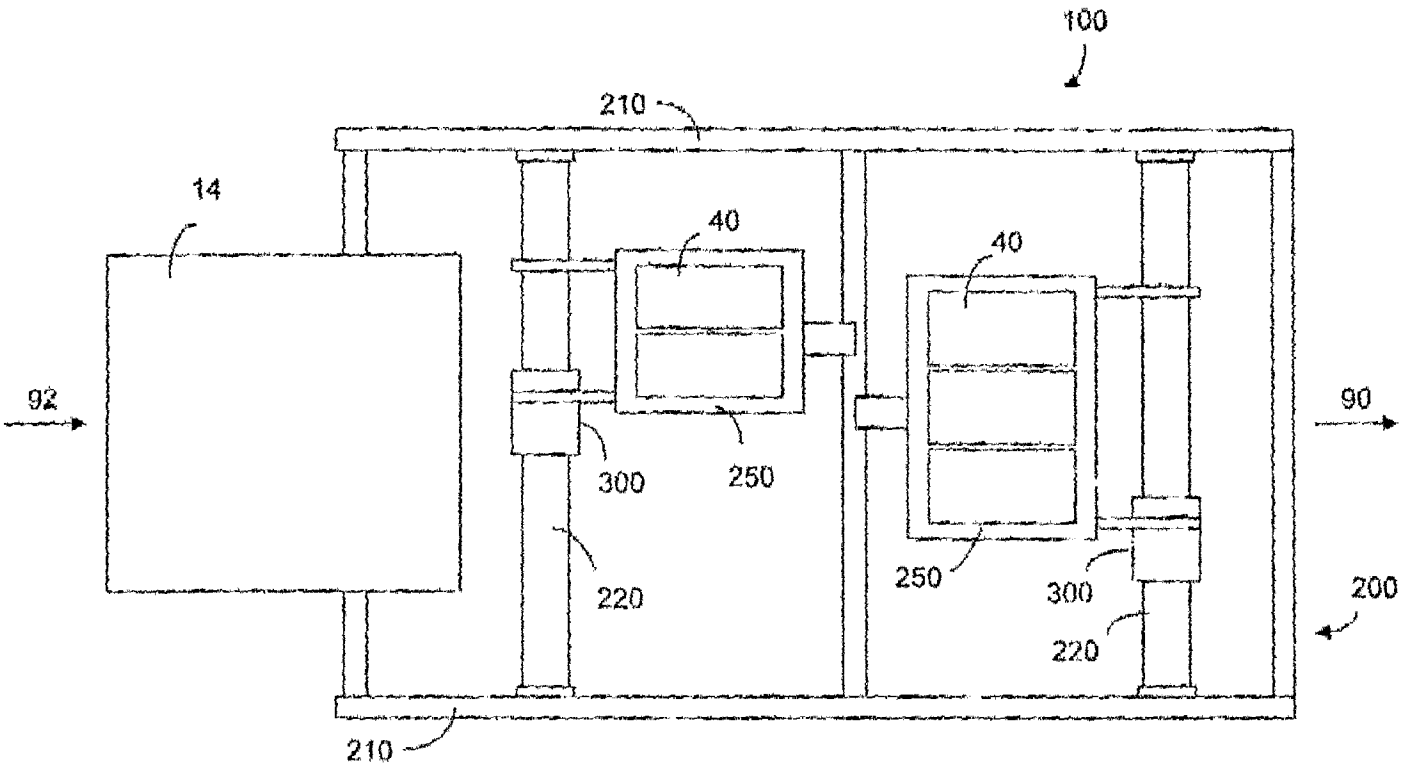
FIG. 2 is a schematic representation showing the top view of the printing section of the addressing machine.
Figure 3:
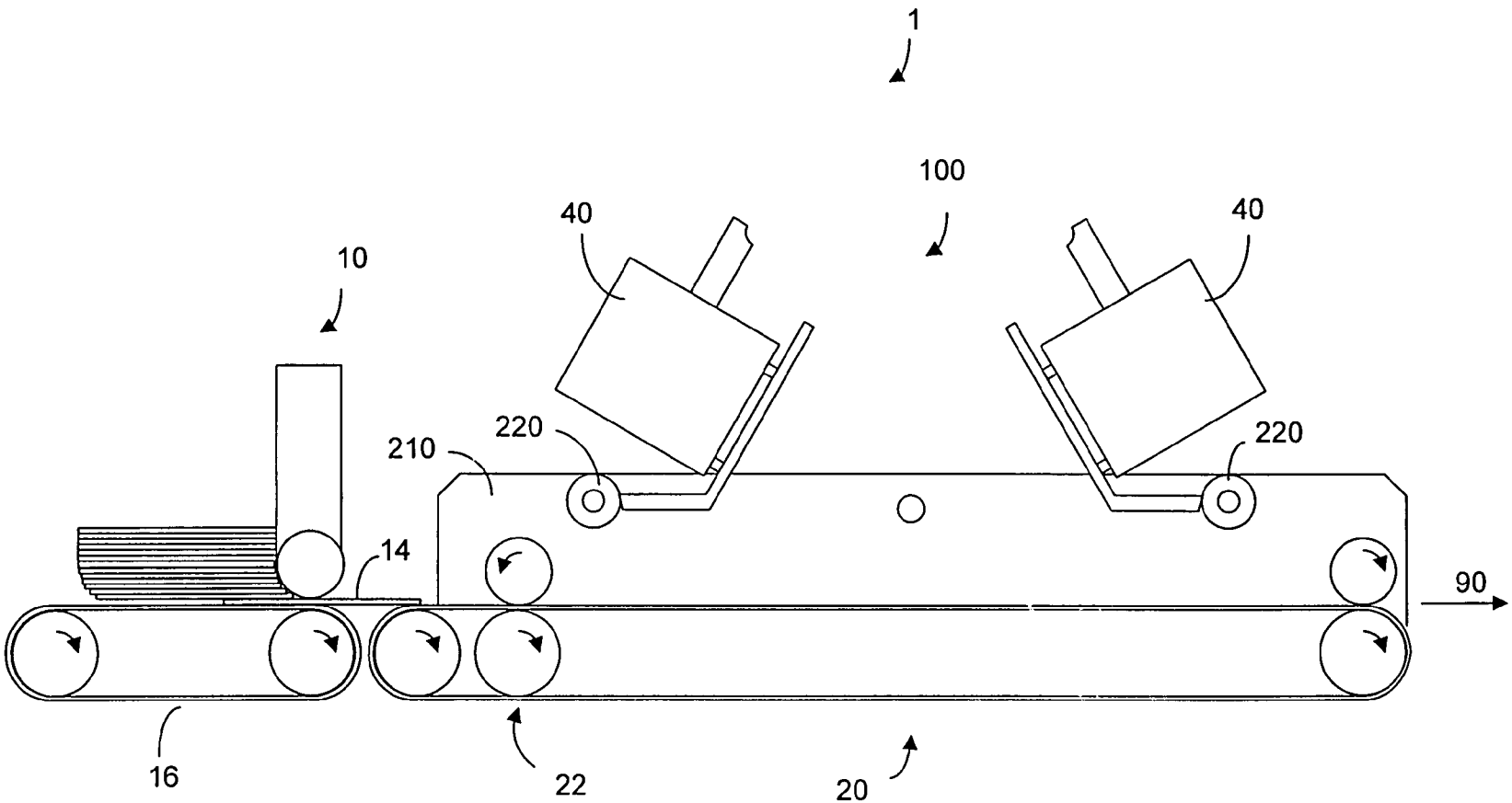
FIG. 3 is a schematic representation showing the print head assemblies are lifted upward for maintenance purposes.

With the locking body 310 of the present invention, the operator can use the lever 352 to rotate the cam ring 360 relative to the locking body 310 to release the pressure exerted on the shaft 220 by the spline 370 and then adjust the position of the print head assembly 40 fixedly mounted on the carriage 50 (see FIG. 2). When the print head assembly 40 is located at a desired position, the operator can use the lever 352 to rotate the cam ring 360 for moving the relief 364 away from the slot 334, thereby locking the print head assembly 40 relative to the moving path 92 of the envelope 14 (see FIG. 2).

Advantageously, a minor relief 366 is also provided on the inner surface of the circular opening 362. As such, when the operator rotates the cam ring 360 from the unlocked position as shown in FIG. 13 to a new position as shown in FIG. 14, the operator can feel that the locked position has been reached.

The shaft 220 can be rotatably mounted on the shaft mount 210 (see FIG. 2), as such, the operator can lift the print head assembly 40 along with the locking body 310, without moving any part of the locking body 310.

As shown in FIGS. 13 and 14, the cam ring 360 is rotated in a counter-clockwise direction from the unlocked position to the locked position. It should be noted that the cam ring 360 has two ends. Either end can be located adjacent to the flange 350. Thus, the cam ring 360 can be installed differently so that it is rotated in a clockwise direction from the unlocked position to the locked position. Furthermore, the lever 352 can be disposed at any desired location on the outer diameter of the cam ring 330, depending on how the print head assembly is mounted on the shaft.

Thus, although the invention has been described with respect to a preferred embodiment thereof, it will be understood by those skilled in the art that the foregoing and various other changes, omissions and deviations in the form and detail thereof may be made without departing from the scope of this invention.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A locking device for use in conjunction with a shaft for engagingly connecting to a carriage, the shaft having a longitudinal axis, said locking device comprising:

a cylindrical body slideably mounted on the shaft, the cylindrical body having an inner circumference, an outer circumference, a thickness defined by the inner and outer circumferences, and an aperture opened through the thickness of the cylindrical body, wherein the cylindrical body further has a mounting mechanism for engagingly attaching the carriage;

an elastomer body, seated in the aperture, for providing a frictional force against the shaft when the elastomer body is pressed toward the shaft; and a cam ring having an inner surface mounted over the outer circumference of the cylindrical body for rotational movement about a rotation axis between a first position and a second position, the rotational axis substantially parallel to the longitudinal axis of the shaft, the cam ring having a clearance on the inner surface, wherein when the cam ring is located at the first position, the clearance is spaced from the aperture, and the inner surface of the cam ring presses the elastomer body toward the shaft, providing a frictional force against shaft, thereby restricting the cylindrical body from moving along the longitudinal axis, and when the cam ring is located at the second position, the clearance is aligned with the aperture on the cylindrical body, allowing the elastomer body to seat partially in the clearance, thereby reducing the frictional force against the shaft such that the cylindrical body can be moved along the longitudinal axis for adjusting the position of carriage along the shaft.

2. The locking device of claim 1, wherein the carriage is used for mounting a print head assembly for printing a mailpiece moving in a moving path, and wherein the cam ring is rotated to the second position for adjusting the position of the print head assembly relative to the moving path based on the mailpiece, and the cam ring is rotated to the first position for locking the print head assembly at the adjusted position.

3. The locking device of claim 1, wherein the cylindrical body has a coaxially extended section, the extended section having an outer circumference, and wherein the carriage has a flange, the flange having an opening for mounting over the outer circumference of the extended section.

4. The locking device of claim 3, wherein the flange has a tab protruding into the opening of the flange, and wherein the extended section has a slot cutting into the outer circumference of the extended section for seating the tab so as to prevent the flange from rotating relative to the extended section.

5. The locking device of claim 3, wherein the extended section has a threaded segment, the locking device further comprising a lock nut for engaging with threaded segment in order to keep the flange fixedly mounted on the extended section.

6. The locking device of claim 5, wherein the cylindrical body has a first end for mounting the cam ring and a second end adjacent to threaded segment of the extended section, and wherein the flange is mounted on the extended section between the lock nut and the cam ring.

7. The locking device of claim 1, wherein the cam ring has a further clearance which is shallower than the clearance such that when the cam ring is located at first position, the elastomer body is partially seated in the further clearance but substantially maintaining the frictional force against the shaft for restricting the cylindrical body from moving along the longitudinal axis.

8. A method for locking and unlocking a carriage engagingly connecting to a shaft having a longitudinal axis, said method comprising the steps of:

1) providing a locking device, slideably mounted on the shaft, for securely attaching the carriage, the locking device comprising:

a cylindrical body, having an inner circumference adjacent the shaft, an outer circumference, a thickness defined by the inner and outer circumferences, and an aperture opened through the thickness of the cylindrical body;

an elastomer body, seated in the aperture, for providing a frictional force against the shaft when the elastomer body is pressed toward the shaft;

a cam ring having an inner surface mounted over the outer circumference of the cylindrical body for rotational movement about a rotational axis, between a first position and a second position, the rotational axis substantially parallel to the longitudinal axis of the shaft, the cam ring having a clearance on the inner surface, such that when the cam ring is located at the first position, the clearance is spaced from the aperture, causing the inner surface to press the elastomer body toward the shaft, thereby providing a frictional force against the shaft, and when the cam ring is located a the second position, the clearance is aligned with the aperture of the cylindrical body, allowing the elastomer body to seat partially in the clearance, thereby reducing the frictional force against the shaft;

2) rotating the cam ring to the second position to reduce the friction force against the shaft, adjusting the position of the carriage along the shaft; and 3) rotating the cam ring to the first position providing the frictional force against the shaft, thereby maintaining the adjusted position of the carriage.

9. The method of claim 8, wherein the cam ring is rotated from the first position to the second position in a clockwise direction.

10. The method of claim 8, wherein the cam ring is rotated from the first position to the second position in a counterclockwise direction.

11. An addressing machine having at least one print head assembly for printing a substantially flat item moving a moving direction, the flat item has a size, the addressing machine comprising:

at least one shaft having a longitudinal axis, substantially perpendicular to the moving direction of the flat item;

a shaft mount for mounting the shaft; and a locking device comprising:

a cylindrical body slideably mounted on the shaft, the cylindrical body having an inner circumference, an outer circumference, a thickness defined by the inner and outer circumferences, and an aperture opened through the thickness of the cylindrical body, wherein the cylindrical body further has a mounting mechanism for engagingly attaching the print head assembly;

an elastomer body, seated in the aperture, for providing a frictional force against the shaft when the elastomer body is pressed toward the shaft; and a cam ring having an inner surface mounted over the outer circumference of the cylindrical body for rotational movement about a rotation axis between a first position and a second position, the rotational axis substantially parallel to the longitudinal axis of the shaft, the cam ring having a clearance on the inner surface, wherein when the cam ring is located at the first position, the clearance is spaced from the aperture, and the inner surface of the cam ring presses the elastomer body toward the shaft, providing a frictional force against shaft, thereby restricting the cylindrical body from moving along the longitudinal axis, and when the cam ring is located at the second position, the clearance is aligned with the aperture on the cylindrical body, allowing the elastomer body to seat partially in the clearance, thereby reducing the frictional force against the shaft such that the cylindrical body can be moved along the longitudinal axis for adjusting the position of carriage along the shaft relative to the moving direction, based on the size of the flat item.

12. The addressing machine of claim 11, configured such that the flat item is an envelope.

13. The addressing machine of claim 11, configured such that the flat item is a sheet of paper.

14. The addressing machine of claim 11, configured such that the flat item is a mailpiece.

* * * * *